US005149920A

United States Patent [19]

Meeker et al.

[11] Patent Number: 5,149,920

[45] Date of Patent: Sep. 22, 1992

[54] ACOUSTICAL PANEL AND METHOD OF MAKING SAME

[75] Inventors: Brian L. Meeker, Maumee; Walter D. Harmon, Newark, both of Ohio

[73] Assignee: Fiber-Lite Corporation, Maumee, Ohio

[21] Appl. No.: 754,167

[22] Filed: Sep. 3, 1991

Related U.S. Application Data

[63] Continuation of Ser. No. 435,201, Nov. 9, 1989, abandoned.

[51] Int. Cl.[5] ..... E04B 1/82

[52] U.S. Cl. ..... 181/290; 181/294

[58] Field of Search ..... 181/290, 291, 292, 293, 181/294; 52/144

[56] References Cited

U.S. PATENT DOCUMENTS

| | | | |
|---|---|---|---|
| 2,732,885 | 1/1956 | Van Der Hoven | 181/294 X |
| 3,082,143 | 3/1963 | Smith | 181/294 X |
| 3,276,928 | 10/1966 | Pearson et al. | 181/294 X |
| 3,328,086 | 6/1967 | Johnston | 181/294 X |
| 3,581,453 | 6/1971 | Jones et al. | 52/144 |
| 3,583,522 | 6/1971 | Rohweder et al. | 181/290 |
| 4,016,234 | 4/1977 | Warren et al. | 181/290 |
| 4,324,831 | 4/1982 | Parrini et al. | 181/294 X |

*Primary Examiner*—L. T. Hix
*Assistant Examiner*—Khanh Dang
*Attorney, Agent, or Firm*—Marshall & Melhorn

[57] ABSTRACT

An acoustical panel comprises a compressed and cured mass of binder impregnated randomly oriented and interentangled fibrous glass bundles. The acoustical panel surprisingly is characterized by high sound absorption coefficients at low frequencies.

20 Claims, 1 Drawing Sheet

ACOUSTICAL PANEL AND METHOD OF MAKING SAME

This application is a continuation of application Ser. No. 07/435,201, filed Nov. 9, 1989 now abandoned.

FIELD OF THE INVENTION

The present invention relates generally to acoustical panels and a method of making the same, and more particularly, to acoustical panels having improved acoustical properties resulting from their unique structure.

BACKGROUND OF THE INVENTION

Acoustical panels are widely used in the construction and allied industries as thermal and sound insulating media. Such panels are generally manufactured from compressed masses of wood fibers, wood pulp, cane fibers, cork granules, gypsum, rock wool, or glass fibers and combinations thereof. A preferred material is glass fibers, which may be formed into panels for use in wall or ceiling construction, sound insulating decorative roof liners for vehicles, mechanical suspension as sound absorbing and transmittance reducing media, etc. Glass fiber panels are generally manufactured by methods well known in the art, such as for example by drawing molten streams of glass into fibers and depositing the fibers in a collecting chamber where they settle, together with an applied binder, onto a traveling conveyor. The fibers form a substantially heterogeneously oriented mass of glass fibers laid in substantially stratified relationship, in planes generally parallel to the surface of the conveyor. The continuously produced fibrous mass is thereafter conveyed through compression, resin curing, and cutting stations, to form panels having overall densities from about 3 to about 12 pounds per cubic foot, depending upon their intended use. Thus, the fibrous glass panels are sufficiently porous to permit the entry of sound energy waves into the interior of the body, where the sound energy strikes individual fibers causing them to vibrate and convert the sound energy into heat energy.

U.S. Pat. No. 2,612,462 to Zettel discloses a laminated insulating block comprised of a layer of low density glass fiber aggregates and one or two surface layers of high density compressed felted glass fibers. The felted layers are compressed in a range of from one-fourth to one-sixth their original thickness, thereby producing relatively hard and dense surfaces to prevent delamination of the lower density aggregate layer The increased density surface layers of felted fibers, however, reduce the acoustical properties of the panel by retarding penetration of sound energy waves, causing a large portion of the sound energy to be reflected away from the panel.

U.S. Pat. No. 2,993,802 to Cascone discloses a fibrous acoustical panel comprised of a densified blanket of fibrous glass having a coating of particulate fibers, e.g., asbestos fibers, which increases the acoustical qualities of the panel. The blanket of fibrous glass is characterized as a mass of heterogeneously arranged fibers, containing sporadically located "swirls" or balls of glass fibers. When the surfaces of the panels are sanded smooth for the subsequent application of decorative layers, those swirls at the surfaces of the panels are truncated, thereby exposing the ends of many upstanding fibers which extend substantially perpendicularly from the surfaces. The presence of these swirls results in a lowered acoustical efficiency. The deleterious effects of these areas is overcome by the application of a dispersion of fibers in a film-forming coating liquid. The coating of fibers is claimed to result in acoustical properties better than those of the bare sanded panel of the same thickness containing the fibrous "swirls".

It would be desirable to produce a fibrous glass acoustical panel, having improved acoustical properties over the panels known in the art, especially having sound absorption capabilities for low as well as high frequency sound waves.

SUMMARY OF THE INVENTION

Accordant with the present invention, and contrary to the teachings of the prior art, an improved acoustical panel has surprisingly been discovered, comprising:

A) a porous mass of randomly oriented interentangled bundles of glass fibers; and B) a cured resinous binder distributed throughout the porous mass and adhered to the glass fibers.

The improved acoustical panels may be produced by a process comprising the steps of:

A) providing a porous blanket of glass fibers, having an uncured resinous binder distributed therein;

B) comminuting the blanket to form bundles of glass fibers, the bundles having a mean particle size from about ¼ inch to about 3 inches;

C) randomly orienting and interentangling the bundles of glass fibers; and

D) simultaneously, compressing the randomly oriented and interentangled bundles of glass fibers, and curing the resinous binder.

The acoustical panels of the present invention are particularly suited for use as sound absorbing ceiling panels, freestanding room partitions, wall coverings, and the like.

BRIEF DESCRIPTION OF THE DRAWINGS

The novel features considered characteristic of the invention are set forth with particularity in the appended claims. The invention itself, however, both as to structure and method of manufacture, will best be understood from the accompanying description of specific embodiments, when read in connection with the attendant drawings, in which:

DETAILED DESCRIPTION OF THE PREFERRED EMBODIMENT

Figure 1:
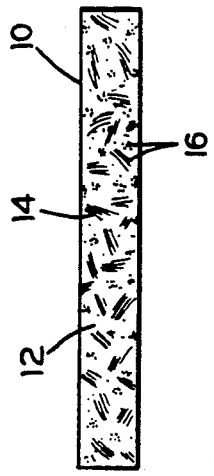
FIG. 1 is a side elevational view of an acoustical panel, embodying the features of the present invention.

Referring now to FIG. 1, there is shown an acoustical panel 10 embodying the features of the present invention. The panel 10 has a porous structure, making it particularly suited for sound absorption, as sound energy waves are permitted to penetrate into the panel through the high number of communicating air cells 12 in the maze of glass fibers 14. The panel 10 comprises bundles 16 of glass fibers, which bundles are randomly oriented relative to each other, and are interentangled with adjacent glass fiber bundles.

Suitable glass compositions for preparing the glass fibers used in the panels of the present invention are those generally known in the art as useful for forming glass fiber wool products. The glass fibers 14 typically have a diameter from about 2 to about 9 microns. Preferably, the diameter is from about 3 to about 6 microns. The glass fiber bundles 16 generally have an average mean particle size from about ¼ inch to about 3 inches. Preferably, the average mean particle size is from about ½ inch to about 1½ inches.

A resinous binder is adhered to at least a portion of the fibers 12 in each bundle 16, and is generally distributed throughout the panel 10 at an overall concentration from about 2% to about 15% by weight. Preferably, the concentration is from about 6% to about 9% by weight. The resinous binder is present in the panel 10 in a hardened or cured state, and holds the interentangled glass fiber bundles 16, as well as the individual fibers 14 within each bundle 16, in intimate, relatively rigid relationship one to another. The resinous binder may be selected from those materials generally known in the art as useful for forming a matrix for glass fiber wool products, such as for example a commercial phenol-formaldehyde, melamine, epoxy, or polyester resin, or mixture thereof. The acoustical panels of the present invention may have an overall density from about 3 to about 12 pounds per cubic foot. Preferably, the overall density is from about 5 to about 8 pounds per cubic foot.

Figure 2:
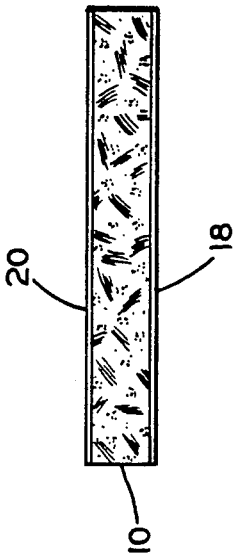
FIG. 2 is a side elevational view of an alternative embodiment of the acoustical panel of FIG. 1, including a support membrane and a decorative layer.

FIG. 2 illustrates an alternative embodiment of the present invention, wherein the panel 10 includes a support membrane 18 adhered to one of the major surfaces of the panel 10, and a decorative layer 20 adhered to the opposite major surface of the panel 10. The support membrane 18 may conveniently comprise a non-woven glass or plastic fiber web, which is adhered to a surface of the panel 10 either by an interposed layer of a conventional adhesive (not shown) or by the cured resinous binder at the interface between the support membrane 18 and the panel 10. The decorative layer 20 may be, for example, an open-weave cloth material adhered to an opposed surface of the panel 10 in the same fashion as the support membrane 18. The support membrane 18 and decorative layer 20 are both very thin relative to the overall thickness of the panel 10, and must be constructed and adhered to the panel 10 in such a manner so as to have substantially no detrimental effect on the sound absorbing characteristics of the bare panel 10. Although only a single support membrane 18 and single decorative layer 20 are adhered to the major surfaces of the panel 10 as illustrated in FIG. 2, it must be understood that the present invention contemplates the use of multiple layers of materials on either or both of the major surfaces of the panel 10, so long as the aforementioned objective is achieved, i.e., the layers do not substantially, detrimentally affect the sound absorbing characteristics of the bare panel 10. By the term "a substantially detrimental effect" as used herein is meant that the panel 10, having one or more layers attached thereto, has a sound absorbing efficiency reduced by more than 10% at any frequency over that of the bare panel 10.

Figure 3:
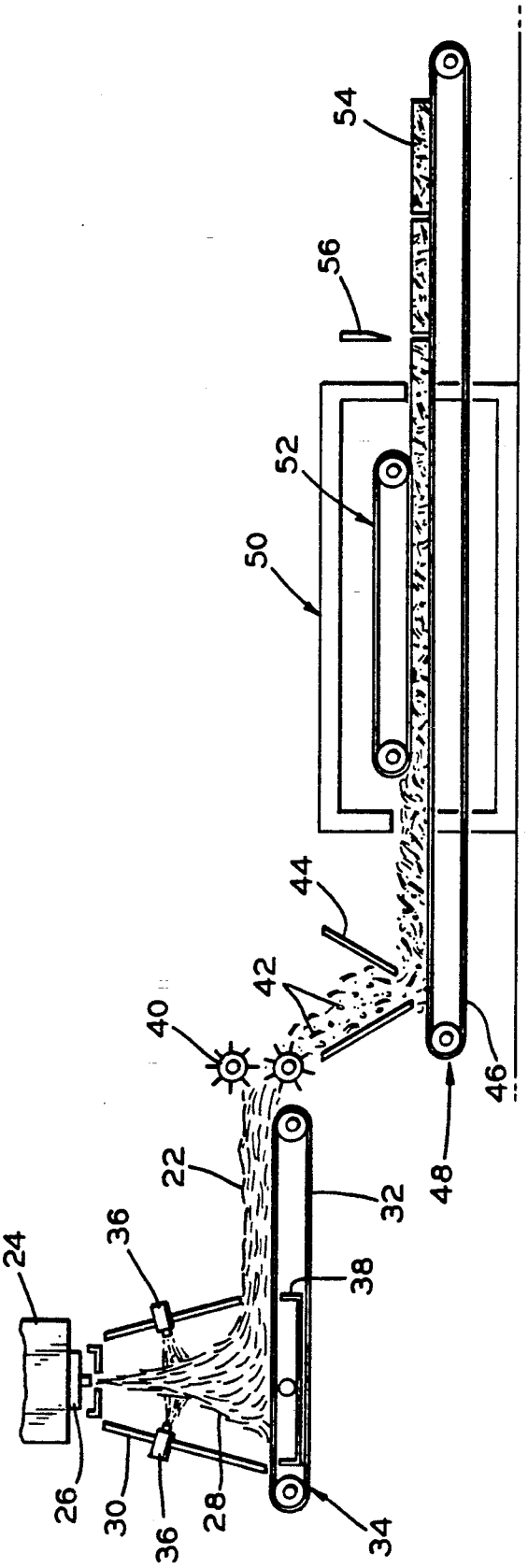
FIG. 3 is a schematic representation of a process for producing acoustical panels, according to the present invention.

Referring now to FIG. 3, there is shown a schematic representation of a process for making acoustical panels, embodying the features of the present invention. It is generally known in the art to produce a porous blanket of fibrous glass 22 by fiberizing molten glass and forming a blanket of the fibrous glass on a moving conveyor. Glass is melted in a tank 24 and supplied to a fiber-forming device 26. Fibers of glass, indicated at 28, are attenuated from the device 26, and move generally downwardly within a forming hood 30. The fibers 28 are deposited on a perforated endless forming belt 32 of a conveyor 34. A resinous binder is applied to the fibers 28, by means of suitable spray applicators 36, in such a manner so as to result in a distribution of the resinous binder throughout the formed blanket of fibrous glass 22. The fibers 28, having the uncured resinous binder adhered thereto, are gathered and formed on the belt 32 with the aid of a vacuum chamber 38 located below the upper run of the belt 32.

The resultant blanket of fibrous glass 22 thereafter is comminuted by a mechanical device 40, thereby converting the blanket 22 into small, discrete pieces or bundles of glass fibers 42. The individual bundles 42 have a mean particle size from about ¼ inch to about 3 inches. Preferably, the mean particle size is from about ½ inches to about 1½ inches. The comminuting device 40 may be any suitable conventional apparatus generally known in the art as useful for converting a blanket of fibrous glass into small discrete pieces or bundles of glass fibers, such as for example a hammer mill, rotary knife cutter, or the like.

The glass fiber bundles 42 are charged through a hopper 44, and deposited in a randomly oriented, interentangled layer having a relatively uniform thickness and density, onto a panel forming conveyor 48. The layered glass fiber bundles 42, containing the uncured resinous binder distributed therein, is advanced by the conveyor 48 through an oven 50. An overlaying conveyor 52 is adapted within the oven 50 for vertical adjustment relative to conveyor 48 by means of a suitable elevating and lowering mechanism (not shown). Each conveyor 48 and 52 is perforated to permit heated gases to pass therethrough, but at the same time resistant to distortion so as to enable the layer of glass fiber bundles 42 to be compressed therebetween. Heated gases are supplied to the oven 50 by a suitable hot gas circulating system (not shown), whereby the heated gasses are passed through the conveyors 48 and 52 and the compressed layer of glass fiber bundles 42. The conveyors 48 and 52 maintain the desired compressed layer thickness while the resinous binder is subjected to curing temperatures, which of course depend upon the particular resinous binder employed. As the compressed, cured layer of glass fiber bundles 42 emerges from the oven 50, it is cut into panels 54 by any conventional cutting means, such as for example a knife 56.

The resultant acoustical panels 54 may have an overall density typically known in the art as useful for providing sound energy absorption. Conveniently, the conveyors 48 and 52 may be set so as to produce panels 54 having an overall density from about 3 to about 12 pounds per cubic foot. Preferably, the density is from about 5 to about 8 pounds per cubic foot. The temperature of the heated gases necessary for curing the resinous binder may vary over a wide range from about 350° F. to about 550° F., depending upon the particular resinous binder and curing time used. A commercial phenol-formaldehyde resinous binder, for example, may be fully cured at a temperature of about 400° F. while maintained between the conveyors 48 and 52 for a period of about 3 minutes.

The acoustical panels of the present invention surprisingly have superior low frequency as well as high frequency sound energy absorption characteristics, relative to the acoustical panels of the prior art. Sound absorption coefficients are determined by directing a sound of constant volume and at different, known frequencies toward the acoustical panel to be tested, and measuring the time required for the sound to decay to a degree where it is no longer audible, and theoretically to one millionth of its original intensity. Typical ranges for sound absorption coefficients for the acoustical panels generally known in the prior art are listed in the following table.

TABLE I

| | Typical Absorption Coefficients for Prior Art Acoustical Panels | | | | | |
|---|---|---|---|---|---|---|
| | Frequency in Cycles per Second | | | | | |
| | 125 | 250 | 500 | 1,000 | 2,000 | 4,000 |
| Range of Sound Absorption Coefficients | .08-.09 | .26-.41 | .70-.77 | .89-.95 | .77-.87 | .58-.73 |

The acoustical panels of the present invention, by contrast, are characterized by sound absorbtion coefficients of at least about 0.80 for frequencies from about 100 to about 500 cycles per second. While not wishing to be bound by any particular theory regarding the improved low frequency sound absorption characteristics of the acoustical panels of the present invention, it is believed that the improvement is due to the structure of the randomly oriented interentangled glass fiber bundles, which present the exposed ends of many glass fibers generally upstanding at various angles over the sound intercepting surface of the panel. As previously stated, various support or decorative layers may be adhered to the acoustical panels of the present invention, as long as such layers do not substantially interfere with the sound absorbing properties of the panel.

While certain representative embodiments and details have been shown for the purposes of illustrating the present invention, it will be apparent to those skilled in the art that various changes in applications can be made therein, and that the invention may be practiced otherwise than as specifically illustrated and described without departing from its spirit and scope.

EXAMPLE

Glass fiber bundles, having a mean particle size of about 1½ inches, and about 8% by weight of a phenol-formaldehyde resinous binder distributed therein, are randomly oriented and interentangled to form a layer of uniform thickness and overall density. The layer is compressed to about 80% of its original thickness, and while maintained in the compressed state is subjected to heated air at about 400° F. for a period of about 3 minutes to cure the resinous binder. The panel thus produced is about 1 inch thick and has an overall density of about 6 pounds per cubic foot. The sound absorption coefficients are measured at various frequencies, and reported as follows:

TABLE II

| | Acoustical Panel Absorption Coefficients | | | | | | | | |
|---|---|---|---|---|---|---|---|---|---|
| | Lower Frequencies, in Cycles per Second | | | | | | | | |
| | 100 | 125 | 160 | 200 | 250 | 315 | 400 | 500 | |
| Absorption Coefficients | 1.05 | 1.09 | 1.06 | 1.08 | 1.07 | 0.89 | 0.91 | 0.79 | |
| | Higher Frequencies, in Cycles per Second | | | | | | | | |
| | 630 | 800 | 1000 | 1250 | 1600 | 2000 | 2500 | 3150 | 4000 |
| Absorption | 0.98 | 0.99 | 1.04 | 1.12 | 1.12 | 1.10 | 1.11 | 1.14 | 1.16 |

TABLE II-continued

| Acoustical Panel Absorption Coefficients |
|---|
| Coefficients |

What is claimed is:

1. An acoustical panel, comprising:

A) a porous mass of a plurality of discrete bundles of glass fiber, wherein the individual glass fibers within each of said bundles are randomly oriented in planes generally parallel to one another, said bundles are randomly oriented relative to each other with at least some of said bundles being disposed in planes not parallel with the major surfaces of said panel, and said bundles ar intertangled with adjacent bundles; and B) a cured resinous binder distributed throughout said porous mass and adhered to said glass fibers;

wherein the sound absorbing coefficient of said panel is at least 0.80 when measured in the range from about 100 to about 500 cycles per second.

2. The acoustical panel according to claim 1, wherein said glass fibers have diameters from about 2 to about 9 microns.

3. The acoustical panel according to claim 2, wherein said glass fibers have diameters from about 3 to about 6 microns.

4. The acoustical panel according to claim 1, wherein said bundles of glass fibers have a mean particle size from about ¼ inch to about 3 inches.

5. The acoustical panel according to claim 4, wherein said bundles of glass fibers have a mean particle size from about ½ inches to about 1½ inches.

6. The acoustical panel according to claim 1, wherein said resinous binder comprises from about 2% to about 15% of the total weight of said panel.

7. The acoustical panel according to claim 6, wherein said resinous binder comprises from about 6% to about 9% of the total weight of said panel.

8. The acoustical panel according to claim 1, wherein said resinous binder is selected from the group consisting of phenol-formaldehyde, melamine, epoxy, and polyester resins, and mixtures thereof.

9. The acoustical panel according to claim 8, wherein said resinous binder is a phenol formaldehyde resin.

10. The acoustical panel according to claim 1, wherein the overall density of said panel is form about 3 to about 12 pounds per cubic foot.

11. The acoustical panel according to claim 10, wherein the overall density of said panel is from about 5 to about 8 pounds per cubic foot.

12. The acoustical panel according to claim 1, further comprising at least one support membrane adhered to said porous mass, which does not substantially, detrimentally affect the sound absorbing characteristics of said panel 13. The acoustical panel according to claim 1, further comprising at least one decorative layer adhered to said porous mass, which does not substantially, detrimentally affect the sound absorbing characteristics of said panel.

14. An acoustical panel, comprising:

A) a porous mass of a plurality of discrete bundles of glass fiber, wherein the individual glass fibers within each of said bundles are randomly oriented in planes generally parallel to one another, and said bundles are randomly oriented relative to each other with at least some of said bundles being disposed in planes not parallel with the major surfaces of said panel, said bundles being intertangled with adjacent bundles and having a means particle size from about ¼ inch to about 3 inches, said glass fibers having diameters from about 2 to about 9 microns;

B) about 2% to about 15% by weight of a cured resinous binder selected from the group consisting of phenol-formaldehyde, melamine, epoxy, and polyester resins, and mixtures thereof, said resinous binder distributed throughout said porous mass and adhered to said glass fibers;

C) at least one support membrane adhered to said porous mass, which does not substantially, detrimentally effect the sound absorbing characteristics of said panel; and D) at least one decorative layer adhered to said porous mass, which does not substantially, detrimentally affect the sound absorbing characteristics of said panel;

wherein the overall density of said panel is from about 3 to about 12 pounds per cubic foot, and the sound absorbing coefficient of said panel is at least 0.80 when measured in the range from about 100 to about 500 cycles per second.

15. The acoustical panel according to claim 14, wherein said glass fibers have diameters from about 3 to about 6 microns.

16. The acoustical panel according to claim 14, wherein said bundles of glass fibers have a means particle size from about ½ inches to about 1½ inches.

17. The acoustical panel according to claim 14, wherein said resinous binder comprises from about 6% to about 9% of the total weight of said panel.

18. The acoustical panel according to claim 14, wherein said resinous binder is a phenol-formaldehyde resin.

19. The acoustical panel according to claim 14, wherein the overall density of said panel is from about 5 to about 8 pounds per cubic foot.

20. An acoustical panel, comprising:

A) a porous mass of a plurality of discrete bundles of glass fiber, wherein the individual glass fibers within each of said bundles are randomly oriented in planes generally parallel to one another, and said bundles are randomly oriented relative to each other with at least some of said bundles being disposed in planes not parallel with the major surfaces of said panel, said bundles being intertangled with adjacent bundles and having a mean particle size from about ½ inch to about 1½ inches, said glass fibers having diameters from about 3 to about 6 microns;

B) about 6% to about 9% by weight of a cured phenol-formaldehyde resinous binder distributed throughout said porous mass and adhered to said glass fibers;

C) at least one support membrane adhered to said porous mass, which does not substantially, detrimentally affect the sound absorbing characteristics of said panel; and D) at least one decorative layer adhered to said porous mass, which does not substantially, detrimentally affect the sound absorbing characteristics of said panel;

wherein the overall density of said panel is from about 5 to about 8 pounds per cubic foot, and the sound absorbing coefficient of said panel is at least 0.80 when measured in the range from about 100 to about 500 cycles per second.

* * * * *